United States Patent [19]

Lagemann

[11] Patent Number: 4,466,236

[45] Date of Patent: Aug. 21, 1984

[54] THREAD-BREAK SENSOR FOR TEXTILE MACHINERY

[75] Inventor: Bernd Lagemann, Göppingen, Fed. Rep. of Germany

[73] Assignee: Zinser Textilmaschinen GmbH, Ebersbach, Fed. Rep. of Germany

[21] Appl. No.: 487,588

[22] Filed: Apr. 22, 1983

[30] Foreign Application Priority Data

Apr. 22, 1982 [DE] Fed. Rep. of Germany ..... 3214996

[51] Int. Cl.[3] ..... D01H 13/16

[52] U.S. Cl. ..... 57/80; 57/86; 57/87

[58] Field of Search ..... 57/78, 80, 81, 83–87

[56] References Cited

U.S. PATENT DOCUMENTS

| | | | |
|---|---|---|---|
| 2,494,490 | 1/1950 | Rinehart et al. | 57/86 |
| 3,163,341 | 12/1964 | Fisher et al. | 57/80 X |
| 3,759,026 | 9/1973 | Hope | 57/80 |
| 4,110,963 | 9/1978 | Plate et al. | 57/86 |
| 4,292,798 | 10/1981 | Gore et al. | 57/86 |

FOREIGN PATENT DOCUMENTS

| | | |
|---|---|---|
| 7912423 | 8/1979 | Fed. Rep. of Germany . |
| 3114919 | 10/1982 | Fed. Rep. of Germany . |

*Primary Examiner*—John Petrakes
*Attorney, Agent, or Firm*—Karl F. Ross; Herbert Dubno

[57] ABSTRACT

A device for detecting a break in one of two tensioned threads merging into a yarn comprises a support on which a guide member with two yarn-bracketing pins is pivotable about a horizontal axis. The guide member is provided with a hole penetrated by a stud of smaller diameter having a head with two or more chordal ridges of different peripheral widths each of which, when brought into a horizontal position above the stud axis, contacts a rabbet on the guide member disposed below its center of gravity to hold that member in a metastable position from which it is dislodged by a difference in the tensions of the two threads. When that difference surpasses a certain threshold, upon rupture of one of the threads, the guide member tilts into an unstable position from which it gravitates through substantially half a turn into an inverted stable position, thereby entangling the remaining intact thread with its pins and inhibiting the advance thereof so that it, too, will rupture. In order to change the threshold of instability, the entire stud or its head may be detached and rotated about its axis into an alternate position in which a ridge of different width lies at the top.

12 Claims, 9 Drawing Figures

THREAD-BREAK SENSOR FOR TEXTILE MACHINERY

FIELD OF THE INVENTION

Our present invention relates to a thread-break sensor designed to be used in a spinning or twisting machine for the purpose of monitoring the integrity of two threads merging into a yarn under tension exerted thereon by a bobbin-carrying spindle, a take-up reel or other drawing means disposed downstream of the thread junction. The threads merged at that junction need not be individual filaments but could also be, for example, slivers advanced by feed rollers of a draw frame.

BACKGROUND OF THE INVENTION

A thread-break sensor of the type here envisaged is known, for example, from German utility model 79 12 423 dated Apr. 28, 1979. This device comprises a swingable member with two symmetrically located pins disposed just downstream of a thread junction for guiding engagement with the yarn in a normal metastable position of that member in which it is held as long as the two threads, bracketed by its pins, are under substantially equal tension. In the event of a difference in tension exceeding a certain threshold, as will be the case upon the occurrence of a thread rupture, the guide member is laterally deflected into an unstable position from which it gravitates into an inverted, stable position by swinging through approximately 180° about a substantially horizontal axis. This causes an inversion of the relative position of the yarn-bracketing pins which thereby become entangled with the remaining, intact thread to inhibit its advance and to cause its break. Such a guide member has also been described in two commonly owned copending U.S. applications filed by me jointly with Herman Güttler, namely Ser. No. 443,561 of Nov. 22, 1982 and Ser. No. 465,922 of Feb. 14, 1983.

It is sometimes desirable to vary the response threshold of such a thread-break sensor in accordance with the type of thread to be used in a given spinning or twisting station equipped therewith. Thus, the threshold of instability ought to be lower with thinner threads under relatively little tension (and, therefore, a rather small stress difference in the event of a break) but should be higher when the tension of each thread may be subject to appreciable variations without a rupture. That threshold is generally determined by the width of a supporting surface of a carrier on which the guide member rests in a centered position and from which it is deflected by a difference between the forces acting upon its pins. Thus, the response threshold of the sensor may be altered by replacing the carrier, e.g. a bolt with a flattened head, by a differently dimensioned carrier designed to support the swingable member. Such a substitution, however, requires the storage of a variety of carriers whose interchange entails considerable down time in the operation of the machine involved.

OBJECT OF THE INVENTION

The object of my present invention, therefore, is to provide an improved thread-break sensor whose instability threshold can be varied between two or more values in an expeditious manner and without the need for storing additional parts.

BACKGROUND OF THE INVENTION

The guide member of my improved thread-break sensor has a contact surface which, in the aforementioned metastable position, rests on a coacting surface of a carrier on a stationary support, that carrier being provided with a plurality of chordal ridges of different peripheral widths that are angularly separated from one another with reference to the swing axis of the guide member; this carrier is selectively orientable in a plurality of different angular positions—termed "operating positions" hereinafter—on the support. In each operating position one of the chordal ridges lies horizontally above the swing axis for coaction with the contact surface of the guide member which, as known, is located below the center of gravity of that member in its metastable position. It is therefore possible, by changing from one operating position to another, to confront the contact edge of the guide member with a ridge of larger or smaller peripheral width so as to increase or reduce the instability threshold of the sensor.

According to a more specific feature of my invention, the carrier referred to comprises an enlarged head on a stud that protrudes from the support. The contact surface of the guide member, in this case, is a rabbet disposed between an upper and a lower part of that member (as viewed in its metastable position), the upper part bearing the pins while the lower part is inserted between the head and the support. This lower part has a hole which is traversed by the stud and whose diameter sufficiently exceeds that of the stud to enable the rabbet to clear the lateral edges of the widest ridge for letting the guide member swing into its inverted position in one or the other direction upon the rupture of a respective thread.

In principle, the stud may be either rigid with the head or integral with the wall on which it is mounted, thus forming part of either the projecting carrier or the support. In the first instance the stud or shank of the bolt-shaped carrier will be removably received in a bore of the supporting wall whose outline, like the cross-section of the stud, should be noncircular so as to enable an interfitting only in the aforementioned operating positions. Thus, the stud profile may be rectangular in the case of two diametrically opposite operating positions, equilaterially triangular in the case of three operating positions spaced 120° apart, or square in the case of four angularly equispaced operating positions. In the second instance, with the head removably fitted onto the stud, these two elements may be provided with similarly shaped mutually complementary formations such as a profiled extremity on the stud and a corresponding bore on the head. In either case, furthermore, the two separable elements ought to be conveniently detachable from and re-engageable with each other; for this purpose I prefer to make the stud of resilient material and to split an extremity thereof into a pair of prongs that are biased toward the periphery of the associated bore for a firm frictional fit. The interengagement can be made more positive by providing one of the prongs with a lug engaging an undercut shoulder of the bore upon complete insertion of the stud into same; the bore, however, will then have to be provided with two or more radial passages—depending on the number of operating positions—for enabling disengagement of the lug from the shoulder by a tool inserted in any of these positions into the respective passage.

It should be noted that, in all the described instances, the guide member may remain on the stud during rotation of the head about its swing axis so that a changeover from one operating position to another can be quickly and easily performed.

BRIEF DESCRIPTION OF THE DRAWING

The above and other features of my invention will now be described in detail with reference to the accompanying drawing in which.

SPECIFIC DESCRIPTION

Figure 1:
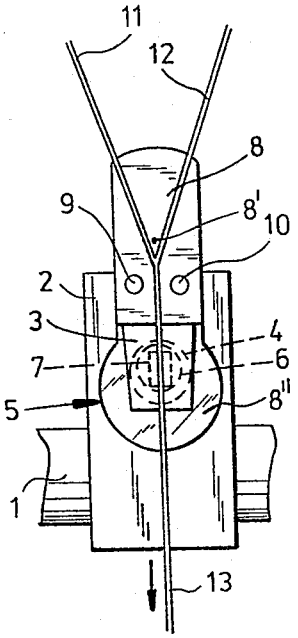
FIG. 1 is a front-elevational view of a thread-break sensor according to my invention in the normal, metastable position of a guide member thereof swingably mounted on a support through the intermediary of a carrier.

FIGS. 1–4 show, as part of a textile plant not further illustrated, a horizontal bar 1 on which a multiplicity of thread-break sensors according to my invention may be mounted at respective spinning or twisting stations. Such a thread-break sensor comprises a stationary support 2 in the form of a prismatic block with a vertical front wall from which a carrier 5 for a swingable guide member 8 projects horizontally. The carrier comprises an enlarged head 3 of trapezoidal profile on a shank or stud which is formed with a cylindrical neck 6, best seen in FIG. 4, and a non-circular extremity 7 of rectangular cross-section received with frictional fit in a correspondingly profiled bore of block 2.

An upper part of guide member 8 is provided with two pins 9 and 10 flanking a plane of symmetry P which passes through the center of gravity 8′ of that member. A disk-shaped lower part 8″, of reduced axial thickness, is interposed between block 2 and head 3, the two parts being separated by a rabbet 14 forming a contact surface which in the metastable position of FIG. 1 is horizontal and rests on a coacting surface 15 of head 3 defined by the major base of the trapezoidal profile of that head. Disk 8″ has a hole 4 whose diameter substantially exceeds that of neck 6 whereby guide member 8 can move radially, to a limited extent, with reference to carrier 5.

Figure 2:
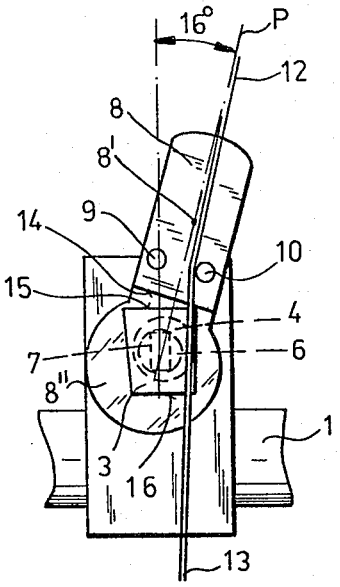
FIG. 2 is a view similar to that of FIG. 1 but showing the guide member deflected into an unstable position by a thread rupture.
Figure 4:
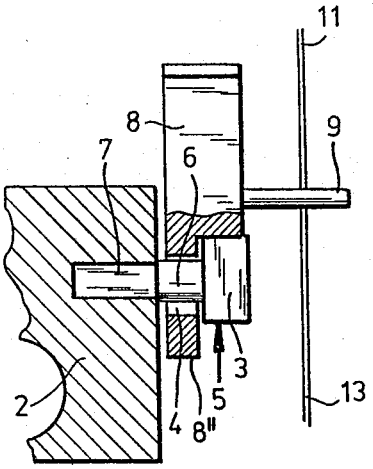
FIG. 4 is a side-elevational view, partly in section, of the thread-break sensor shown in FIG. 1.

Two textile threads 11 and 12 are seen in FIG. 1 to pass between the pins 9 and 10, merging in the vicinity of these pins into a yarn 13 which is continuously drawn under tension toward an associated station (not shown) of the spinning or twisting machine. The junction point of these threads could also be lower than illustrated in FIG. 1, with each thread contacting one of the pins. In any event, guide member 8 will remain in the position of FIG. 1 as long as there is no substantial unbalance between the tensile stresses of the two threads; even a minor stress difference may lift the rabbet 14 only partly off its supporting surface 15. When, however, that difference reaches a certain threshold, here assumed to be due to a rupture of the left-hand thread 11, the intact thread 12 pulls the member 8 to one side into an unstable position in which its center of gravity lies just to the right of the right-hand edge of surface 15 as illustrated in FIG. 2. From this unstable position, as is well known in the art, the member 8 will swing under its own weight into an inverted position in which the pins 9 and 10 come to lie below the carrier 5 while the thread 12 is quickly entangled by these pins so as to rupture under the continuously exerted tractile force. This inversion of the guide member may also generate an alarm by tripping a relay, e.g. as taught in commonly owned German laid-open application 31 14 919 published Oct. 28, 1982.

Figure 3:
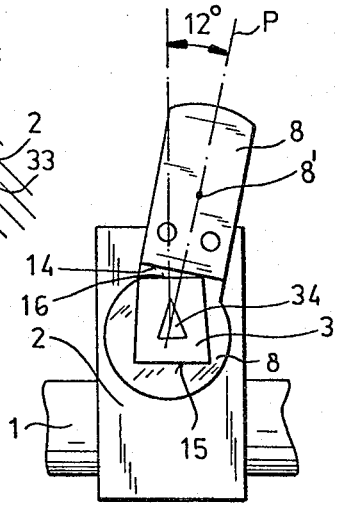
FIG. 3 is a view similar to FIG. 2 but showing a different operating position of the carrier supporting the guide member.

In the carrier position of FIGS. 1 and 2, in which the major base 15 of its profile lies at the top, the threshold of instability is that tension difference which deflects the midplane P of member 8 by an angle of 16° from the vertical as indicated in FIG. 2. If, however, the carrier 5 is rotated through 180° so that its minor base 16 supports the rabbet 14, as shown in FIG. 3, this instability position is reached already after a lateral deflection of 12° so that the response threshold of the sensor is considerably lower. The rectangular profiles of shank extremity 7 and of the corresponding bore of block 2 readily enable such an inversion of carrier 5 after it has been detached from the block by an axial motion which does not even require a removal of member 8 from that carrier.

It will sometimes be desirable to let a supervisor determine from a distance which of the two operating positions of carrier 5 is being used. For this purpose I may provide the front face of head 3 with a visual marking, as shown at 34 in FIG. 3, indicating whether the narrower or the wider base of its profile supports the guide member 8. As particularly illustrated, this marking may be a triangle with its vertex pointing toward the narrower base. Such a marking is especially useful when the difference in width is so small as to be ascertainable only upon close-up inspection.

It will be apparent that each of the two bases 15 and 16 extends along a chord of a circle centered on the carrier axis which, in effect, is also the swing axis of member 8. Thus, the two trapezoid bases and similar surfaces described hereinafter may be referred to as chordal ridges.

Figure 5:
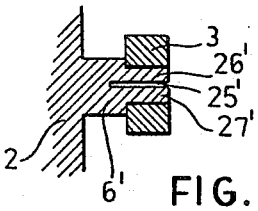
FIG. 5 is a fragmentary axial sectional view illustrating a modified carrier.

FIG. 5 illustrates a modified carrier limited in this instance to the head 3 which is detachably mounted on a stud integral with block 2, a cylindrical neck 6′ of this stud terminating in a split extremity with two prongs 26′ and 27′ separated by a narrow axial gap 25′. With the stud formed of metal or other suitably elastic material, the prongs wedged into a bore of head 3 engage same with a firm frictional fit without, however, preventing the separation of that head from the stud by the exertion of sufficient force. Such a split extremity could, of course, also be used with the carrier 5 of the preceding embodiment.

Figure 6:
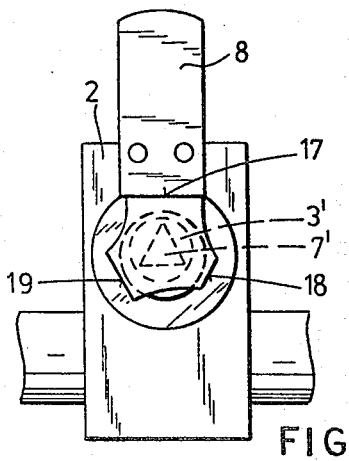
FIGS. 6 and 7 are front-elevational views similar to FIG. 1, showing further embodiments.

FIG. 6 shows a thread-break sensor similar to that of FIGS. 1–4 but provided with a carrier whose head 3′ has three angularly equispaced chordal ridges 17, 18 and 18 of different widths. As in the preceding embodiment, the widest ridge 17 is still somewhat narrower than the contact surface of member 8. The shank of the carrier is provided in this instance with an extremity 7' whose cross-section is an equilateral triangle, conforming to that of a bore of block 2 in which it is received. Thus, the device of FIG. 6 enables the selective establishment of three different instability thresholds. If desired, the front face of head 3' could again be provided with some visual marking indicative of its operating position.

Figure 7:
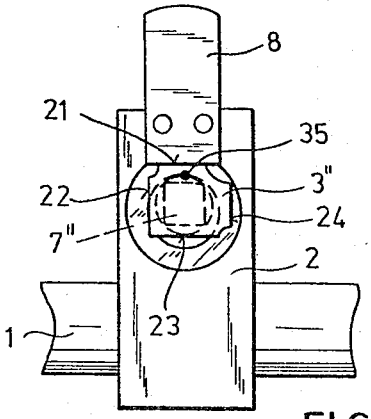

In FIG. 7 a head 3'' of a carrier is provided with four chordal ridges 21–24 of different widths spaced 90° apart, the profile of its shank extremity 7'' being square. Aside from the possibility of establishing as many as four different thresholds, the device of FIG. 7 operates in the same manner as that of FIG. 6. A visual position indicator on the front face of head 3'' is shown as a dot 35.

Figure 8:
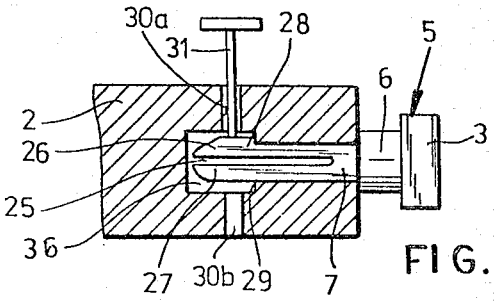
FIG. 8 is a side view, partly in axial section, of a support and a carrier interfitted in a modified manner.

FIG. 8 illustrates the possibility of providing a shank extremity 7 with two prongs 26 and 27 separated by an axial gap 25, in a manner generally similar to that shown in FIG. 5. Here, however, prong 26 is shown formed with a radial lug 28 which in the inserted position reaches behind an undercut shoulder 29 of the bore 36 of block 2 receiving that extremity. In order to facilitate a dislodgment of the shank from block 2, the same is provided with as many radial passages as there are operating positions, two of them being shown at **30*a* and 30*b*. Each of these passages facilitates the introduction of a small tool 31 which depresses the confronting lug 28 against the elastic biasing force of prong 26 to enable a withdrawal of extremity 7 from the block. It will be evident that one of the prongs 25', 26' of FIG. 5 could be similarly provided with a lug projecting beyond the front face of head 3 for a positive interlocking thereof with support 2, 6'**, this lug being directly accessible for repression when the head is to be detached.

Figure 9:
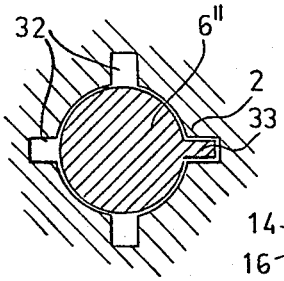
FIG. 9 is a cross-sectional view, drawn to a larger scale, of a support and a carrier detachably interfitted in yet another manner.

In FIG. 9, finally, I have shown a neck 6'' of a carrier provided with a radial tooth 33 receivable in any one of four peripherally equispaced recesses 32 of a cylindrical bore of supporting block 2. The stud of the carrier will therefore fit into the block in any of four different operating positions, spaced 90° apart, in which one of four chordal ridges, such as those shown at 21–24 in FIG. 7, supports the rabbeted contact surface 14 of the associated guide member. Similar configurations could, of course, be used when the radially recessed bore is that of a carrier head while the stud is integral with a supporting block in the manner illustrated in FIG. 5. Naturally, fewer than four recesses 32 will be provided if the head has less than four ridges. The indexing arrangement of FIG. 9 is also entirely compatible with an interlocking fit as described with reference to FIG. 8.

It should be noted that, in every instance, the ridges of the head should be substantially tangent to a common circle centered on the stud axis in order to let the rabbet of the guide member freely rest thereon in any operating carrier position.

The provision of more than four operating positions corresponding to as many instability thresholds, while theoretically possible, will generally not be necessary.

I claim:

1. In a thread-break sensor comprising a stationary support, a carrier projecting from said support with a substantially horizontal axis, and a guide member on said carrier swingable about said axis, said guide member being provided with two pins on opposite sides of a plane of symmetry passing through a center of gravity of said guide member for engagement with respective threads merging under tension into a continuously advancing yarn at a junction below said pins, said guide member further having a contact surface normally resting on a coacting surface of said carrier in a metastable position in which said center of gravity is located above said surfaces, rupture of one of said threads causing the tension of the remaining thread to deflect said guide member laterally from said metastable position into an unstable position from which said guide member gravitates through substantially half a turn into a stable inverted position with resulting entanglement of said remaining thread with said pins and inhibition of further advancement thereof whereby said remaining thread is also ruptured, the improvement wherein said carrier is provided with a plurality of angularly separated chordal ridges of different peripheral widths and is selectively orientable in a like plurality of different angular positions on said support in which respective ridges lie horizontally above said axis for coaction with said contact surface, thereby establishing a plurality of thresholds of instability for a difference in the tension of said threads sufficient to cause a swing of said guide member into said stable position thereof.

2. A thread-break sensor as defined in claim 1 wherein said carrier comprises an enlarged head on a stud protruding from said support, said contact surface being a rabbet between an upper part of said member bearing said pins and a lower part of said member inserted between said head and said support, said lower part having a hole traversed by said stud and of larger diameter than the latter to enable said rabbet to clear the lateral edges of the widest of said ridges.

3. A thread-break sensor as defined in claim 2 wherein said stud is rigid with said support, said head being separable from said stud for reassembly therewith in a different angular position.

4. A thread-break sensor as defined in claim 2 wherein said head has a front face provided with a marking visually indicating the angular position thereof.

5. A thread-break sensor as defined in claim 2 wherein said head is rigid with said stud and is separable jointly therewith from said support for a change into a different angular position.

6. A thread-break sensor as defined in claim 5 wherein said stud has a polygonal cross-section receivable in any of said angular positions in a correspondingly polygonal bore of said support.

7. A thread-break sensor as defined in claim 6 wherein the number of said ridges is two, said cross-section being rectangular.

8. A thread-break sensor as defined in claim 6 wherein the number of said ridges is three, said cross-section being equilaterally triangular.

9. A thread-break sensor as defined in claim 6 wherein the number of said ridges is four, said cross-section being square.

10. A thread-break sensor as defined in claim 1 wherein said support and said carrier are axially separable from each other and have mutually complementary formations matingly interfitting only in angular positions in which respective ridges are disposed horizontally above said axis.

11. A thread-break sensor as defined in claim 10 wherein said formations include a stud and a bore, said stud consisting of resilient material and having an extremity split into a pair of prongs biased toward the periphery of said bore.

12. A thread-break sensor as defined in claim 11 wherein said bore has an undercut shoulder, one of said prongs being formed with a lug engaging said shoulder from within upon complete insertion of said stud into said bore, the latter being laterally accessible through a plurality of radial passages for enabling disengagement of said lug from said shoulder by a tool inserted in any of said angular positions into a respective passage.

* * * * *